US006533250B2

(12) United States Patent
Arthur

(10) Patent No.: US 6,533,250 B2
(45) **Date of Patent: *Mar. 18, 2003**

(54) ENERGY DISSIPATING SYSTEM FOR A CONCRETE ROADWAY BARRIER

(76) Inventor: W. Eugene Arthur, PO Box 739, Hayward, CA (US) 94543

( * ) Notice: Subject to any disclaimer, the term of this patent is extended or adjusted under 35 U.S.C. 154(b) by 2 days.

This patent is subject to a terminal disclaimer.

(21) Appl. No.: 09/933,207

(22) Filed: Aug. 20, 2001

(65) Prior Publication Data

US 2002/0000543 A1 Jan. 3, 2002

Related U.S. Application Data

(63) Continuation-in-part of application No. 09/418,844, filed on Oct. 15, 1999, now Pat. No. 6,276,667.

(51) Int. Cl.[7] ..... E01F 15/00

(52) U.S. Cl. ..... 256/13.1; 256/19; 404/6; 404/7; 404/9

(58) Field of Search ..... 256/13.1, 19; 404/6, 404/7, 9

(56) References Cited

U.S. PATENT DOCUMENTS

| | | | | | |
|---|---|---|---|---|---|
| 2,047,992 | A | * | 7/1936 | Berk | 256/13.1 |
| 2,167,635 | A | * | 8/1939 | Camp | 256/13.1 |
| 3,317,189 | A | * | 5/1967 | Rubenstein | 256/13.1 |
| 4,000,882 | A | * | 1/1977 | Penton | 256/13.1 |
| 4,362,424 | A | * | 12/1982 | Barber | 293/107 |
| 4,435,106 | A | * | 3/1984 | Forster et al. | 256/13.1 |
| 4,681,302 | A | | 7/1987 | Thompson | |
| 4,909,661 | A | * | 3/1990 | Ivey | 188/377 |
| 4,982,931 | A | * | 1/1991 | Pomero | 256/13.1 |
| 5,054,954 | A | | 10/1991 | Cobb et al. | |
| 5,192,157 | A | * | 3/1993 | Laturner | 256/13.1 |
| 5,531,540 | A | * | 7/1996 | Wasserstrom et al. | 256/13.1 |
| 5,660,496 | A | * | 8/1997 | Muller et al. | 256/13.1 |
| 5,938,385 | A | | 8/1999 | Garfield et al. | |
| 6,010,275 | A | * | 1/2000 | Fitch | 256/13.1 |

FOREIGN PATENT DOCUMENTS

| | | |
|---|---|---|
| DE | 2337498 | 2/1975 |
| SU | 1495405 | 7/1989 |

OTHER PUBLICATIONS

Peds Barrier Published May 1998 3 pages.

* cited by examiner

*Primary Examiner*—Anthony Knight
*Assistant Examiner*—Chris Boswell
(74) *Attorney, Agent, or Firm*—Jacox, Meckstroth & Jenkins

(57) ABSTRACT

An energy dissipating system is mounted on the side surface of an elongated concrete median or roadway barrier and includes a longitudinally extending flexible sheet of low friction plastics material having upper and lower edge portions secured to the barrier and with an intermediate portion of the sheet defining a longitudinally extending cavity with the side surface. An elongated energy dissipating member extends horizontally within the cavity, and in one form, comprises a set of resilient cylindrical tubes of extruded plastics material with a smaller tube enclosed within a larger outer tube. In another form, the energy dissipating member includes helically extending compression plastic spring coils disposed between the resilient inner and outer tubes.

18 Claims, 2 Drawing Sheets

10
14
16
32
36
25
28
16
18
45
48
52
18
22
22
12
34

38
32
36
16
28
42
25
45
10
52
48
18
42
38
34
36
22
12

38
32
36
16
25
42
10
48
52
45
52
48
28
18
42
38
34
36
22

45'
58
52'
48'
48'

56
59
58
55
52'

ENERGY DISSIPATING SYSTEM FOR A CONCRETE ROADWAY BARRIER

RELATED APPLICATION

This application is a continuation-in-part of U.S. patent application Ser. No. 09/418,844, filed Oct. 15, 1999, U.S. Pat. No. 6,276,667.

BACKGROUND OF THE INVENTION

The use of concrete median barriers between opposing lanes of interstate highways and along other roadways has been a major advancement in the reduction of head-on collisions and other accidents between approaching vehicles on the roadways. The Type 50 concrete barrier is primarily used because of its inclined lower surface on each side of the barrier adjacent the roadway for straightening a front vehicle wheel which rides up on the barrier when the vehicle accidentally approaches the barrier at a small angle of incidence. However, when a vehicle impacts the concrete barrier at a high angle of incidence, the high friction hard surface of the concrete barrier and the higher impact force commonly result in significantly greater damage to the vehicle and to the barrier as well as greater injuries to the vehicle driver and passengers in the vehicle. In fact, some impacts will either crack the concrete barrier and/or cause the vehicle to spin out of control, sometimes resulting in accidents with other vehicles moving on the roadway.

There have been several systems proposed or used for reducing the damages to motor vehicles and injuries to their occupants when the vehicles accidentally impact the concrete median barriers. One system is known as the PEDS Barrier which has been used along vehicle race tracks and incorporates a continuous series of vertical cylinders. Each cylinder has a diameter of about 16" and is constructed of a high density polyethylene. The cylinders are positioned adjacent the concrete wall or barrier and are covered by an overlapping sheet of high density polyethylene material. The cylinders are secured to the barrier by longitudinally spaced cables extending around the barrier, and the sheet is attached by bolts to the cylinders. The cost of this system is substantial and is therefore primarily used on concrete walls or barriers at race tracks adjacent the seating area for patrons.

U.S. Pat. No. 4,681,302 and U.S. Pat. No. 5,054,954 disclose other forms of energy absorbing roadway barriers which involve formed or molded sheets or bodies of plastics material to form a container defining a chamber. The chamber is filled with a liquid or a filler material which can absorb impact forces, sometimes by being forced out of the container when the container is crushed by an impacting vehicle.

With any such form of energy absorbing or dissipating system which is constructed to form or modify highway median barriers, it is highly desirable for the system to be of economical construction and to be easily and quickly installed along the highway or on an existing concrete barrier so that disruption of traffic on the adjacent roadway lane is minimized. It has also been found desirable for the device to dissipate or distribute the energy of an impacting vehicle and to minimize the friction between the device and the vehicle and guide the vehicle so that the vehicle is redirected back into the adjacent traffic lane with a minimum loss of speed in order to reduce vehicle accidents and injuries to occupant in the vehicles. It is further desirable for the energy dissipating system or device to withstand impacts at high angles of incidence and from high speed vehicles without damaging the device or the concrete barrier so that maintenance on the barrier and device is minimized.

SUMMARY OF THE INVENTION

The present invention is directed to an improved energy dissipating system or device which is ideally suited for mounting on a concrete roadway barrier and which provides all of the desirable advantages mentioned above. That is, the device of the invention helps to maintain control of a vehicle which impacts a barrier and is effective to reduce damage to the vehicle and to the concrete barrier, especially when the vehicle impacts at a higher speed over 50 mph and/or at a higher angle of incidence such as up to thirty degrees. The system or device of the invention is also economical in construction, may be quickly and easily attached to an existing concrete barrier and minimizes the loss of speed of an impacting vehicle so that the driver may return the vehicle to the adjacent lane without disrupting traffic in the lane.

In accordance with one embodiment of the invention, an energy dissipating system or device includes a flexible sheet of heavy gauge plastics material having a low coefficient of friction. The sheet has a width of about 24" and a length of about 60". The sheet has upper and lower edge portions which are attached or secured to a side surface of a concrete barrier by longitudinally spaced concrete anchors and screws, and the down lane end portion of each sheet overlaps the up lane end portion of the adjacent sheet. A longitudinally extending cavity is defined between the sheet and the side surface of the concrete barrier, and an elongated resilient energy dissipating member extends longitudinally within the cavity. In one form, the energy dissipating member comprises an elongated plastic inner tube having a 3" diameter and confined within a similar outer tube having a 4" diameter. In another embodiment, an energy dissipating member comprises helically extending resilient plastic turns or coils disposed between the inner and outer tubes, and the inner tube is formed by a wrapped sheet of plastics material. A plurality of tube sets or assemblies or other forms of resilient energy dissipating members may also be confined within the cavity.

Other features and advantages of the invention will be apparent from the following description, the accompanying drawing and the appended claims.

DESCRIPTION OF THE PREFERRED EMBODIMENTS

Figure 1:
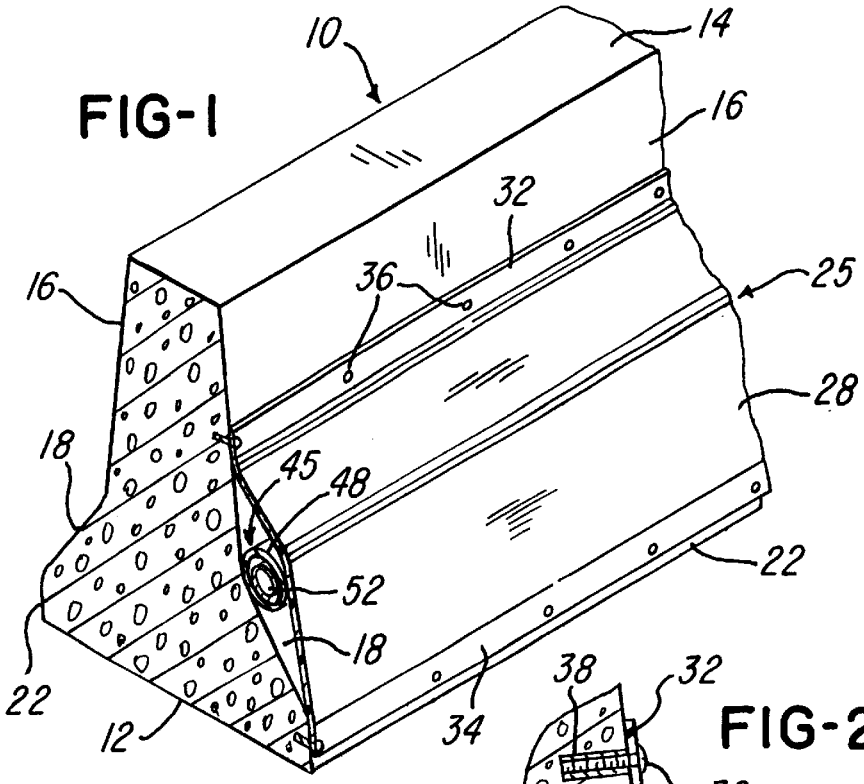
FIG. 1 is a fragmentary perspective view of a concrete median barrier having an energy dissipating system or device constructed and attached in accordance with the invention.

FIG. 1 illustrates a concrete median barrier 10 which has a construction and cross-sectional configuration commonly referred to as a Type 50. This particular barrier has a height of about 32" a base surface 12 having a width of about 24" and a top surface 14 having a width of about 6". The barrier 10 also has opposite upper side surfaces 16 which have a slight taper or incline and opposite lower side surfaces 18 which have a steeper incline and which connect the upper side surfaces 16 to bottom vertical side surfaces 22. Commonly, the barrier has a length of about 10 feet, but may be longer or shorter. While a Type 50 concrete barrier is illustrated, it is to be understood that other types of barriers may also be enhanced and improved by an energy dissipating device or system 25 constructed in accordance with the present invention.

Figure 2:
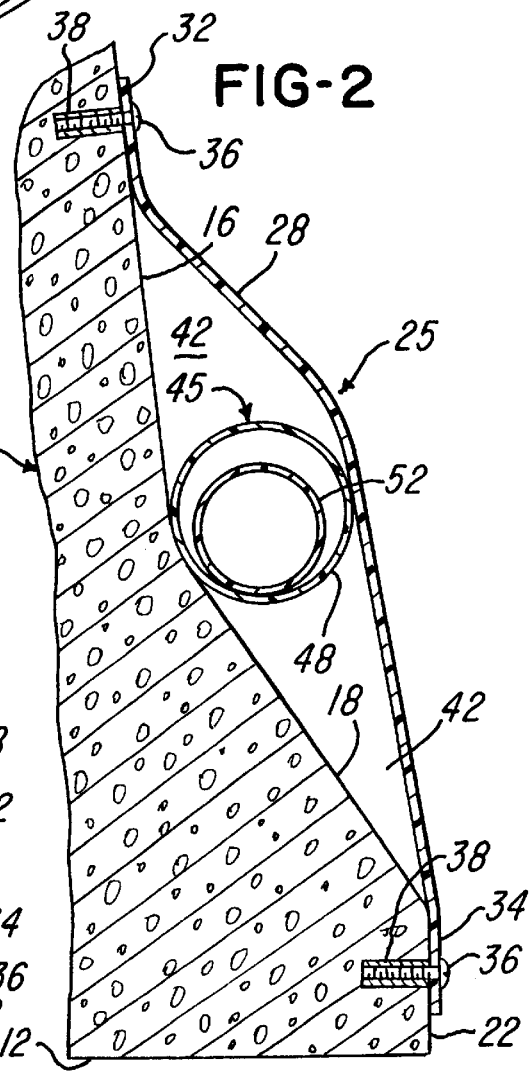
FIG. 2 is an enlarged fragmentary vertical section through the concrete barrier and energy dissipating system shown in FIG. 1.

As shown in FIG. 2, the energy dissipating system or device 25 includes a low-friction flexible sheet 28, preferably of a plastics material having a uniform wall thickness of about ¼" and a coefficient of friction substantially lower than the coefficient of friction of the side surfaces 16 and 18 of the concrete barrier. One form of sheet 28 which has provided satisfactory results is a sheet produced by Poly Hi Solidur and sold under the trademark TIVAR 1000. This material is ultra-slick, is chemical and corrosion resistant, can withstand substantial impacts, sheds water and can outwear steel in sliding abrasion due its extremely low coefficient of friction. However, other sheet materials could also be used, such as a DELRIN sheet produced by Dupont, a CELCON sheet produced by Celenese or a high-density polyethylene sheet.

Preferably, the sheet 28 has a width of about 24" and a length of 60". The sheet 28 includes a longitudinally extending upper edge portion 32 and a lower edge portion 34 which are releasably secured or fastened to the corresponding side surfaces 16 and 22 of the barrier 10 by longitudinally spaced fasteners or screws 36 which extend into tubular concrete anchors 38 inserted into holes drilled within the surfaces. The screws 36 provide for removing the sheet 28 in the event the sheet was accidentally torn. However, other fastening or securing means or more permanent fastening means may be used to secure the edge portions 32 and 34 of the sheet 28 to the side surfaces of the concrete barrier.

As apparent from FIG. 2, the flexible sheet 28 cooperates with the obtuse angled surfaces 16 and 18 of the concrete barrier 10 to define a longitudinally extending cavity 42 which has open ends and receives a longitudinally extending resilient cylindrical energy dissipating member 45. In one form, the member 45 includes a longitudinally extending resilient outer tube 48 and resilient cylindrical inner tube 52 each of which is extruded of a flexible plastics material such as high or low density polyethylene, polypropylene or rubber. The energy dissipating member 45 may also be an elongated body of resilient plastic or rubber foam or tubes filled with such foam or other resilient material such as pieces of rubber tires, or a tube 48 may be extruded with internal webs to provide the resiliency and return to its normal condition.

In the illustrated embodiment which provided satisfactory test results, the outer tube 48 has a diameter of about 4", a length of about 58" and a wall thickness of about ⅛". The inner tube 52 has a diameter of about 3" a length of about 58" and a wall thickness of ⅛". The cover sheet 28 has a length which is a couple of inches longer than the tubes 48 and 52 so that the down road end portion of each sheet 28 overlaps the up road end portion of each adjacent sheet while the ends of the tubes 48 and 52 abut the ends of the adjacent corresponding tubes extending along the length of the adjacent concrete barrier section.

Figure 3:
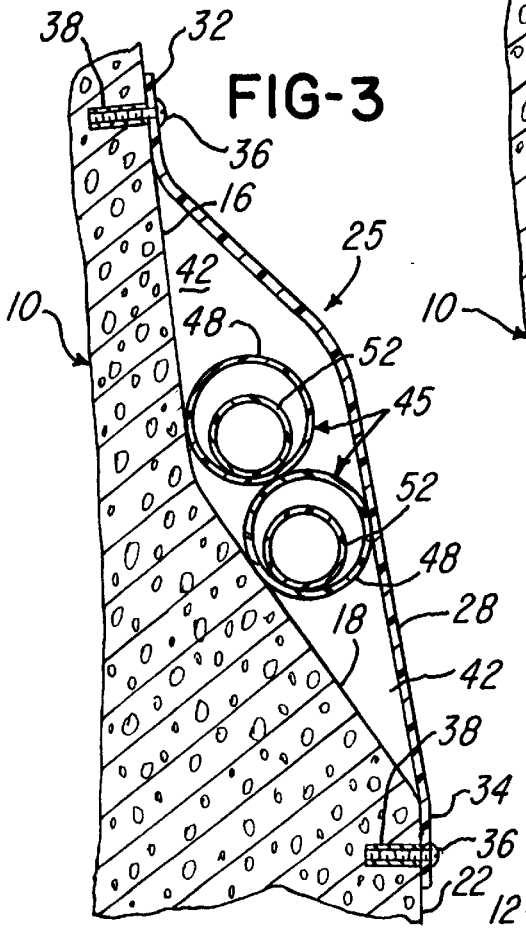
FIG. 3 is a small section similar to FIG. 2 and showing a modification of the invention.

As illustrated in FIG. 3, it is also within the scope of the invention to position a plurality of elongated energy dissipating members 45 within the cavity 42 depending upon the particular form of elongated energy dissipating member 45 used, the location of the concrete barriers relative to the roadway and the extent of impact forces desired to be dissipated by the energy dissipating system of the invention. To facilitate rapid installation of the system 25, the outer tube 48 may be preattached at longitudinally spaced locations on the sheet 28 by longitudinally spaced fasteners such as rivets.

Figures 4, 5:
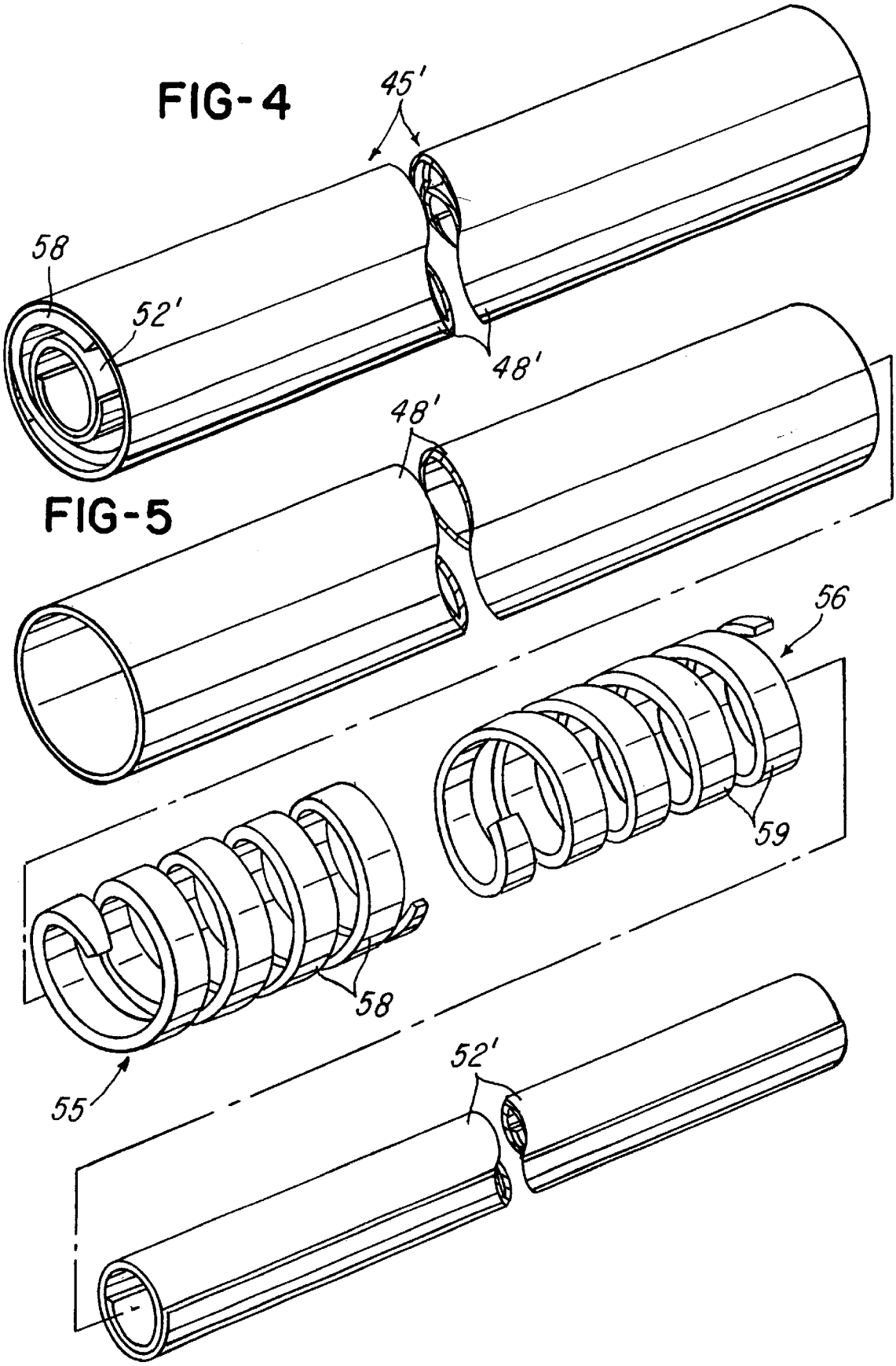
FIG. 4 is a fragmentary perspective view of another energy dissipating system constructed in accordance with the invention and with a center portion broken away.
FIG. 5 is an exploded perspective view of the energy dissipating system shown in FIG. 4.

Referring to FIGS. 4 & 5 which illustrate another embodiment of an energy dissipating system constructed in accordance with the invention, a resilient energy dissipating member 45' is used in place of the energy dissipating member 45 and extends horizontally within the cavity 42 either in place of or supplementing the member 45. The member 45' includes an outer flexible and resilient tube 48' extruded of the same plastics material as the tube 48 and encloses an inner flexible and resilient tube 52' which may be extruded of the same plastics material as the tube 52 or may be formed by wrapping a heated sheet or strip of plastics material around a mandril.

Position between the tubes 48' and 52' are a series of helical spring coils 55 and 56 each of which is formed by helically wrapping an extruded flat strip of thermoplastics material such as nylon around a mandril after the strip is heated or while the strip is hot. As shown in FIG. 5, preferably, the spaced helical turns 58 of the coil 55 extend in a left hand direction, and the spaced turns 59 of the adjacent coil 56 extend in a right hand direction so that the series of coils 55 and 56 alternate within the elongated outer tube 45' which extends a predetermined length, for example 5 to 10 feet, as mentioned above. Preferably, the assembly of the coils 55 and 56 and the inner tube 52' are lubricated within the outer tube 45', for example, by a silicone spray. After the lubricated coils 55 and 56 and inner tube 52' are lubricated and inserted within the outer tube 45', molded plastic end caps are inserted and attached within opposite ends of the outer tube 45' to prevent dirt and water from entering each of the longitudinally extending energy dissipating members 45'.

From the drawings and the above description, it is apparent that an energy dissipating system constructed in accordance with the present invention, provides desirable features and advantages. As a primary advantage, the energy dissipating system, including the flexible plastic sheet 28 having a low coefficient of friction and one or more of longitudinally extending resilient energy dissipating members such as the members 45 or 45', all mounted on a barrier or wall surface, is effective to redirect and guide an impacting vehicle back into the adjacent roadway lane with a minimum loss of speed of the vehicle. This significantly reduces the chance of an accident caused by the impacting vehicle as well as reduces or eliminates damage to the impacting vehicle and damage to the barrier.

The energy dissipating system of the invention is also economical in construction since the sheet 28 and outer tube 48 or 48' and inner tube 52 are commercially produced in high volume for other uses. In addition, an energy dissipating device or system of the invention may be quickly installed on a concrete barrier or wall extending along a highway, thus minimizing the interruption of traffic in the adjacent lane and the exposure of the installers to the traffic. Furthermore, the slickness of the low friction sheet 28 minimizes friction and prevents the tires and bumpers of an impacting motor vehicle from scraping the rough surface of the concrete barrier. It is also apparent when the resilient tubes 48 or 48' and tubes 52 and 52' are collapsed in response to an impact on the sheet 28, the air within the tubes is compressed and flows out the open ends of the tubes so that the energy from the impact is dissipated longitudinally along the length of the device. The resilient compression spring coils 55 and 56 with the spaced helical turns have also been found effective in dissipating impact energy by axial compression of the coils upon receiving an impact force against the sheet 28.

While the method and forms of energy dissipating device herein described constitute preferred embodiments of the invention, it is to be understood that the invention is not limited to the precise method and forms described, and that changes may be made therein without departing from the scope and spirit of the invention as defined in the appended claims.

What is claimed is:

1. An energy dissipating system in combination with an elongated concrete roadway barrier wall having a side surface extending parallel to the roadway and effective to reduce accidents and damage to motor vehicles moving on the roadway, said system comprising an elongated flexible sheet of plastics material having substantial thickness and overlying said side surface, said sheet including a longitudinally extending upper portion and a longitudinally extending lower portion integrally connected by an intermediate portion, said upper and lower portions of said sheet being attached to said barrier wall and said intermediate portion of said sheet being spaced from said side surface of said barrier wall to define a longitudinally and generally horizontally extending cavity between said sheet and said side surface, and at least one elongated and resilient energy dissipating member extending generally horizontally within said cavity.

2. A system as defined in claim 1 wherein said energy dissipating member comprises an elongated tube of resilient and flexible plastics material extending generally horizontally within said cavity.

3. A system as defined in claim 2 wherein said tube is generally cylindrical.

4. A system as defined in claim 2 wherein said tube encloses a second elongated resilient tube of flexible plastics material.

5. A system as defined in claim 1 and including a plurality of said energy dissipating members extending longitudinally and generally horizontally within said cavity.

6. A system as defined in claim 1 and including a series of longitudinally spaced threaded fasteners securing said upper and lower portions of said sheet to said barrier wall.

7. A system as defined in claim 1 wherein said energy dissipating member comprises an elongated tube of plastics material and enclosing a compressible spring coil of plastics material.

8. A system as defined in claim 1 wherein said flexible sheet of plastics material has a substantially uniform thickness of about one quarter inch.

9. An energy dissipating system in combination with an elongated concrete roadway barrier wall having a side surface extending parallel to the roadway and effective to reduce accidents and damage to motor vehicles moving on a roadway, said system comprising an elongated flexible sheet of plastics material having substantial thickness and overlying said side surface, said sheet including a longitudinally extending upper portion and a longitudinally extending lower portion integrally connected by an intermediate portion, said upper and lower portions of said sheet being attached to said barrier wall and said intermediate portion of said sheet being spaced from said side surface of said barrier wall to define a longitudinally extending cavity between said sheet and said side surface, and at least one elongated resilient tube of flexible plastics material extending longitudinally and generally horizontally within said cavity.

10. A system as defined in claim 9 wherein said tube is generally cylindrical.

11. A system as defined in claim 9 wherein said tube comprises an outer tube enclosing a second elongated and smaller resilient inner tube of flexible plastics material.

12. A system as defined in claim 11 and including at least one compressible spring coil of plastics material disposed between said inner and outer tubes.

13. A system as defined in claim 9 wherein said flexible sheet of plastics material has a substantially uniform thickness of about one quarter inch.

14. A method of constructing an energy dissipating system on a side surface of an elongated concrete roadway barrier wall extending parallel to a roadway to reduce the chance of a moving motor vehicle causing an accident on the roadway, comprising the steps of forming an elongated flexible sheet of plastics material with the sheet having a longitudinally extending upper portion integrally connected to a longitudinally extending lower portion by an intermediate portion, attaching the upper longitudinal portion and the lower longitudinal portion of the sheet to the barrier wall with the intermediate portion of the sheet and the side surface of the barrier wall defining a longitudinally and horizontally extending cavity therebetween, and extending an elongated and resilient energy dissipating member generally horizontally within the cavity.

15. A method as defined in claim 14 and including the step of extending an elongated resilient tube of flexible plastics material generally horizontally within the cavity to form the energy dissipating member.

16. A method as defined in claim 15 and including the step of extending a second and small elongated resilient tube of flexible plastics material within the first tube within the cavity.

17. A method as defined in claim 16 and including the step of positioning at least one compressible spring coil of plastics material within an annular space defined between the first and second tubes within the cavity.

18. A method as defined in claim 16 and including the step of positioning a series of compressible spring coils of plastics material within an annular space defined between the first and second tubes, an extending helical turn of each coil in a direction opposite to helical turn of each adjacent coil.

* * * * *